United States Patent [19]

La Padura

[11] Patent Number: 5,018,411

[45] Date of Patent: May 28, 1991

[54] MULTIPLE-HEAD TOOL

[76] Inventor: Nathan P. La Padura, 508 Brinley Ave. #5, Bradley Beach, N.J. 07735

[21] Appl. No.: 355,298

[22] Filed: May 22, 1989

Related U.S. Application Data

[63] Continuation-in-part of Ser. No. 216,511, Jul. 3, 1988, abandoned.

[51] Int. Cl.[5] ..... B25B 17/00

[52] U.S. Cl. ..... 81/57.5; 81/438; 81/437

[58] Field of Search ..... 81/181, 182, 177.4, 81/437–440, 490, 57.5

[56] References Cited

U.S. PATENT DOCUMENTS 966,529 8/1910 Cunningham ..... 81/57.5

1,616,300 2/1927 Bido ..... 81/438

4,774,736 10/1988 Brawner et al. ..... 81/437

*Primary Examiner*—J. J. Hartman

*Attorney, Agent, or Firm*—Michael B. Einschlag

[57] ABSTRACT

Multiple-head tool such as a multiple-head screwdriver includes an electrically insulated handle; a shaft which has one end inserted into the handle; a multiple-headed bit which is mounted to rotate within a slot in the other end of the shaft; and an electrically insulated sleeve which is mounted to move along the shaft and to rotate about the shaft. In use, the multiple-head bit is rotated so that the desired head extends outward from and substantially parallel to the shaft and another tool or a spur is disposed within and substantially parallel to the slot. The sleeve is then moved down the shaft to cover at least a portion of the slot to enclose and hold the head or spur disposed therein rotationally fixed.

14 Claims, 4 Drawing Sheets

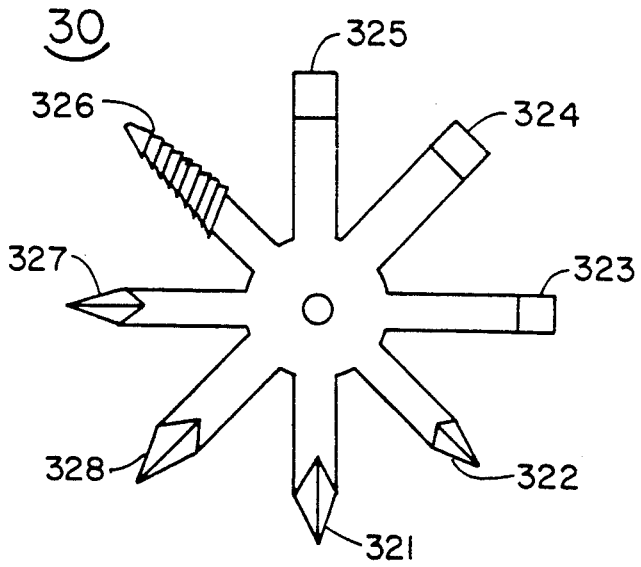
FIG. 5
FIG. 4
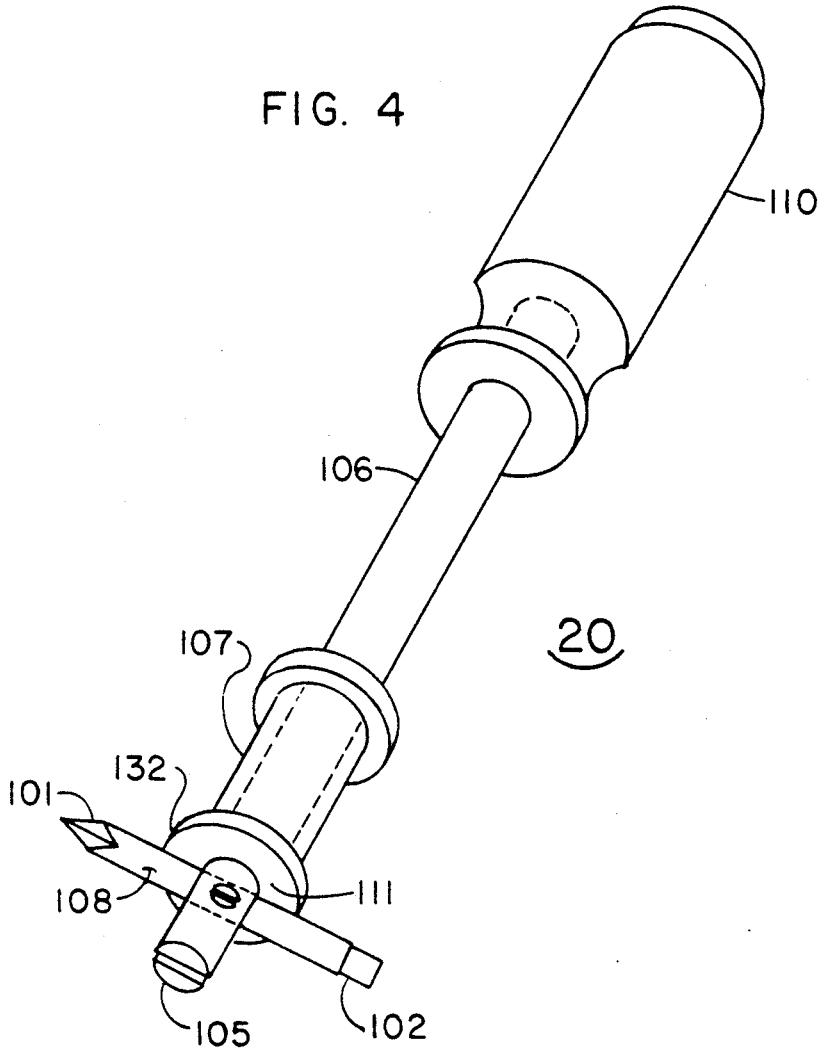

MULTIPLE-HEAD TOOL

This is a continuation-in-part of patent application Ser. No. 216,511, filed on July 3, 1988, now abandoned.

BACKGROUND OF THE INVENTION

1. Technical Field of the Invention

The present invention pertains to the field of hand and power tools and, in particular, to multiple-head tools such as a multiple-head screwdriver.

2. Discussion of the Prior Art

Most people perform repairs in and about their house or apartment or build various implements such as desks, cabinets and so forth for use in and about their home or apartment. As these people can attest, there are many occasions when they need to use tools such as screwdrivers which have several different types of heads—such as "flat-head" screwdrivers, "phillips-head" screwdrivers, "robertson-head" screwdrivers, "hex-head" screwdrivers and so forth—as well as tools such as screwdrivers which have several different sizes of a particular type of head.

A common method of satisfying the above-identified need for using tools having several different types of heads has been to provide a multiplicity of different types of heads of a multiplicity of different sizes which can individually be fitted into a chuck in a handle. Such a solution has proved to be unsatisfactory for the primary reason that one constantly misplaces heads while working and, worse, one loses heads permanently. Further, another drawback of this common solution is that one often finds it difficult to change heads while working because the heads are often not conveniently at hand.

Another method of satisfying the above-identified need for using tools having several different types of heads has been to provide a multiple-head tool. Such a solution has proved unsatisfactory because such tools do not include a means for holding and steadying the head of the tool with one hand —without changing position the grip of the one hand—while applying torque to the handle of the tool with the other hand. In addition, such tools do not provide protection from electric shock when the tools are used around electrical wires, especially when the head is gripped to steady the aim and/or to improve the stability of the screwdriver when in use.

There have been many other attempts in the prior art to solve the above-identified need but they have all been unsatisfactory for one reason or another. For example, some such attempts pertaining to the first type of solution discussed above are found in U.S. Pat. Nos. 3,799,226, 4,328,721, 4,463,788, 4,476,751, and 4,488,462 and some such attempts pertaining to the second type of solution discussed above are found in U.S. Pat. Nos. 385,791, 750,182, 910,789, 966,529, 1,616,300, 2,629,415, 3,014,388, 4,512,693, 4,590,824, 4,774,736.

U.S. Pat. No. 3,799,226 issued on Mar. 26, 1974 discloses a screwdriver having a multiplicity of individual heads. The heads are rotatably mounted within a blade holder. The blades may be rotated to a first position for use or rotated to a second position for storage in a chamber in a handle. The disclosed screwdriver has several drawbacks. A first drawback is that there is no means for holding and steadying the head with one hand while applying torque to the handle with the other hand. A second drawback is that there is no protection from electric shock when it is used around electrical wires, especially when the head is gripped to steady the aim and/or to improve the stability of the screwdriver when in use. A third drawback is that the disclosed screwdriver is complex and, therefore, expensive to manufacture.

U.S. Pat. No. 4,328,721 issued on May 11, 1982 discloses a phillips-head screwdriver having a retractable slotted blade which forms a flat-head screwdriver. The phillips-head and the flat-head are interchanged by means of a twist-lock mechanism and a lever or button. The disclosed screwdriver suffers from the drawback that it only has two heads, i.e., a single sized phillips-head and a single sized flat-head, in addition to the drawbacks discussed above with respect to the screwdriver disclosed in U.S. Pat. No. 3,799,226.

U.S. Pat. No. 4,476,751 issued on Oct. 16, 1984 discloses a screwdriver having a multiplicity of heads which are stored in a handle. The heads may individually be inserted into position for use without being detached from the screwdriver. The disclosed screwdriver has several drawbacks which are similar to the drawbacks discussed above with respect to the screwdriver disclosed in U.S. Pat. No. 3,799,226.

U.S. Pat. No. 4,476,751 issued on Oct. 16, 1984 discloses a screwdriver having a multiplicity of independent heads. The heads are each independently rotatably mounted at one end of a handle. Each head can be rotated for storage along the handle or rotated to extend outward from the handle for use. The disclosed screwdriver has several drawbacks which are similar to the drawbacks discussed above with respect to the screwdriver disclosed in U.S. Pat. No. 3,799,226.

U.S. Pat. No. 4,488,462 issued on Dec. 18, 1984 discloses a screwdriver having a phillips-head and a flat-head. The disclosed screwdriver suffers from the drawback that it only has two heads, i.e., a single sized phillips-head and a single sized flat-head, in addition to the drawbacks discussed above with respect to the screwdriver disclosed in U.S. Pat. No. 3,799,226.

In addition, there have been other attempts at solving the above-stated problem in which a multiplicity of different heads are each rotatably affixed to a handle in close proximity to each other. These attempts have failed because, in general, they are awkward to use, are unnecessarily bulky, and are fabricated from metal so that one must take special precautions when handling them around electricity.

U.S. Pat. No. 385,791 discloses a tool which combines in one structure, a bit (or gimlet), a countersink (or reamer), and a screwdriver. The disclosed tool suffers from the drawbacks that there is no means for holding and steadying the head with one hand while applying torque to the handle with the other hand; there is no protection from electric shock when it is used around electrical wires, especially when the head is gripped to steady the aim and/or to improve the stability of the screwdriver when in use; and the disclosed screwdriver is complex and, therefore, expensive to manufacture.

U.S. Pat. No. 750,182 discloses a screwdriver with a reversible head. The tool suffers from the drawbacks discussed above with respect to the tool disclosed in U.S. Pat. No. 385,791.

U.S. Pat. No. 910,789 discloses a multiple-headed tool comprised of, for example, a multiplicity of watch-makers' tools of different sizes. Further, the tools which are not used are covered by a smooth shield. The tool suffers from the drawback that, although the shield may be grasped to steady the tool and help in applying torque, the shape of the shield is such that one cannot maintain contact with the shield without changing the position of the hand that grasps it. Further, because the disclosed tool is to be used for purposes of repairing watches, there is no disclosure of a protection from electricity. Lastly, the mechanism for fixing a tool in place for use is complex and, therefore, expensive to manufacture.

U.S. Pat. No. 966,529 discloses a mulitple-headed tool comprised of, for example, a multiplicity of watchmakers' key elements. The tool suffers from the drawback that there is no means for holding and steadying the head with one hand while applying torque to the handle with the other hand. Further, because the disclosed tool is to be used for purposes of repairing watches, there is no disclosure of a protection from electricity. Lastly, the mechanism for fixing a tool in place for use is complex and, therefore, expensive to manufacture.

U.S. Pat. No. 1,616,300 discloses a screwdriver with a reversible head which is pivotally mounted in a slot at one end of a shaft. The other end of the shaft is inserted into a handle. A ferrule is slidably mounted on the shaft and is adapted to hold the reversible head at the forward end of the shaft in an operative position. In addition, the ferrule has a notch cut in each end and a pin so that the ferrule may engage the bit in the groove so that the head can be disposed at an oblique or at a right angle to the shaft. The disclosed tool suffers from the drawbacks that there is no means for holding and steadying the head with one hand while applying torque to the handle with the other hand and there is no protection from electric shock when it is used around electrical wires, especially when the head is gripped to steady the aim and/or to improve the stability of the screwdriver when in use.

U.S. Pat. No. 2,629,415 discloses a double edged screwdriver having a reversible handle. The screwdriver has opposed working edges disposed at opposite ends of the shank. The tool suffers from the drawbacks discussed above with respect to the tool disclosed in U.S. Pat. No. 385,791.

U.S. Pat. No. 3,014,388 discloses a multiple-headed tool comprised of, for example, a multiplicity of screwdrivers, Allen wrenches, socket wrenches, and so forth of varying sizes. The tool suffers from the drawbacks discussed above with respect to the tool disclosed in U.S. Pat. No. 385,791.

U.S. Pat. No. 4,512,693 discloses a reversible drill and drive tool holder. The tool suffers from the drawbacks discussed above with respect to the tool disclosed in U.S. Pat. No. 385,791.

U.S. Pat. No. 4,590,824 discloses a reversible bladed screwdriver. The tool suffers from the drawbacks discussed above with respect to the tool disclosed in U.S. Pat. No. 385,791.

U.S. Pat. No. 4,774,736 discloses a tool for skateboards which has a pair of oppositely disposed screwdriver heads disposed at one end. The disclosed tool suffers from the drawbacks that there is no means for holding and steadying the head with one hand while applying torque to the handle with the other hand; and there is no protection from electric shock when it is used around electrical wires, especially when the head is gripped to steady the aim and/or to improve the stability of the screwdriver when in use.

As one can readily appreciate from the above, there exists a need in the art for a multiple-head tool such as a multiple-head screwdriver which has: (1) a multiplicity of heads of varying head type and/or varying head size in a single unit to provide ready access thereto to prevent loss of heads and (2) means for holding and supporting the head with one hand while the other hand supplies torque to rotate the head, which means protects against electric shock.

SUMMARY OF THE INVENTION

Embodiments of the present invention solve the above-described problem in the prior art by advantageously providing a multiple-head tool such as a multiple-head screwdriver which has: (1) a multiplicity of heads of varying head type and/or varying head size in a single unit to provide ready access thereto to prevent loss of heads and (2) means for holding and supporting the head with one hand while the other hand supplies torque to rotate the head, which means protects against electric shock.

An embodiment of the present invention is a multiple-head tool such as a multiple-head screwdriver comprised of a handle, a shaft which has one end inserted into the handle, a multiple-head bit which is mounted to rotate within a slot in the other end of the shaft; and a sleeve which is mounted to move along the shaft, wherein: (a) at least the outer surface of the sleeve rotates about the shaft; (b) at least the outer surface of the sleeve is comprised of an electrically insulating material; and (c) the sleeve further comprises a lip means which is disposed on the outer surface and which is spaced a predetermined distance from the ends of the sleeve to prevent a hand which grips the outer surface of the sleeve from sliding thereoff.

In a preferred embodiment of the present invention, the multiple-head bit of the multiple-head screwdriver comprises a rod having a flat-head bit at one end, a phillips-head bit at the other end, and a transversely disposed aperture located substantially in the center of the rod. The multiple-head bit is disposed in the slot of the shaft and is rotatably mounted therein by an axle means. The axle means is mounted in a transversely disposed aperture in the shaft and passes through the aperture in the rod. One bit of the multiple-head bit is placed in position for use as follows: (1) the sleeve is moved towards the handle so that the rod is free to rotate by 360° within the slot; (2) the rod is rotated so that the longitudinal extent thereof is disposed to be substantially parallel with the shaft and one end of the rod is disposed substantially in the slot, this should place the desired bit in a position so that it extends outward from and substantially parallel to the shaft and (3) the sleeve is then moved down the shaft towards the slotted end thereof to cover at least a portion of the rod which is disposed within the slot. In this configuration, the sleeve acts as a retainer for the rod and prevents it from rotating. The exposed end of the rod, i.e., the portion of the rod which is not disposed within the slot and which extends outward therefrom contains the desired bit. For example, in a first configuration, the flat-head bit is disposed within the slot and the phillips-head bit is extended for use and in a second configuration the phillips-head bit is disposed within the slot and the flat-head bit is extended for use.

At least the outer surface of the sleeve is covered with an electrically insulating material and the sleeve further comprises a lip means which is disposed on the outer surface, which lip means is spaced a distance from the ends of the sleeve to prevent a hand which grips the outer surface of the sleeve from sliding thereoff. For example, in an embodiment which is used with a shaft having a substantially circular cross-section, the sleeve is comprised of a single piece of electrically insulating material whereas, in an embodiment which is used with a shaft having, for example, a hexagonal cross-section, the sleeve may be comprised of an inner tube having an inner, hexagonal cross-section and an outer, circular cross-section and an outer tube comprised of electrically insulating material, which outer tube has inner and outer circular cross-sections and wherein the lip means is disposed on the outer surface of the outer tube. Further, because the outer surface of the sleeve may be rotated about the shaft, by 360° in either direction in the preferred embodiment, the user may grip the multiple-head screwdriver with one hand on the handle to apply a torque and with the other hand on the sleeve. This provides enhanced stability during screw-tightening or screw-loosening. Advantageously, this enables the user to apply more pressure than he or she might otherwise be able to apply while, at the same time, to prevent the screwdriver's head from slipping off the screw head.

In the preferred embodiment, the handle and the sleeve are advantageously formed from an electrically insulating material such as teflon. The use of a teflon sleeve enables one to use the multiple-head screwdriver around electrical wires without getting a shock. Further, use of a teflon sleeve provides a relatively friction free surface for rotation thereof about the shaft.

Many further variations of the above-described preferred embodiment exist. For example, the slotted end of the shaft may have a larger outer diameter than the other end of the shaft. This configuration is be used to provide a relatively snug fit between the shaft and the sleeve when the sleeve is disposed at or near the slotted end. As a result of this, the sleeve will be prevented frOm falling away from the slotted end when the screwdriver is used. Further, a stop means may be disposed at or near the slotted end of the shaft. This may be used to provide a stop for the movement of the sleeve and to prevent further movement towards the slotted end when the screwdriver is used. Still further, the sleeve may have a further lip means disposed on its outer sur-±ace near the end or knurls or other deformities impressed on its outer surface. These may be used to provide a means to aid in pushing and/or pulling the sleeve easily along the shaft and for gripping it when the screwdriver is used In further embodiments of the present invention, the shaft may be fabricated to be removablably insertable into the handle in order to provide a multiplicity of multiple-head bits. Further, the end of the shaft which is inserted into the handle of a screwdriver may also be fabricated so that it may be inserted into the chuck of a drill. In this manner, the multiple-head bit may be used in a powered apparatus such as, for example, an electric drill.

In still further embodiments of the present invention, the multiple-head bit may advantageously be comprised of a multiplicity of tools radially extending from central pivot. In one such embodiment, screwdriver heads are disposed at various angular positions about the central pivot where pairs of these heads are disposed at 180° orientations with respect to each other. One bit of the multiple-head bit of this embodiment is placed on position for use as follows: (1) the sleeve is moved towards the handle so that the bit is free to rotate by 360° about the pivot within the slot; (2) the multiple-head bit is rotated until the desired bit extends outward from and substantially parallel to the shaft and, as a result, the oppositely directed bit which is oriented at 180° with respect to the desired bit will be disposed within and substantially parallel to the slot in the shaft; and (3) the sleeve is then moved down the shaft towards the slotted end thereof to cover at least a portion of the bit which is disposed within the slot. In another such embodiment, instead of each bit having a paired bit disposed at 180° with respect thereto, some of these pairs may include a bit which is oppositely disposed from a spur or a shaft. These embodiments are used in the same manner as the mulitple-head embodiment described above, except that when the multiple-head bit is rotated until the desired bit extends outward from and substantially parallel to the shaft, the oppositely directed spur or shaft will be disposed within and substantially parallel to the slot in the shaft.

In yet still further embodiments of the present invention, the sleeve may be long enough to cover the entire shaft and provide electrical insulation therefor. In such an embodiment, the shaft could have recess means for accepting the shaft when it is displaced towards the handle in order to change tool head.

As one can readily appreciate, the above-described multiple-head bit, shaft and sleeve is not only restricted to screwdriver heads and other tools may be placed on the multiple-head bit. For example, an awl may advantageously be placed on a multiple-head bit which otherwise contains screwdriver-head bits. This enables one to start a hole for a screw and to insert the screw with one tool. Further, in other advantageous embodiments of the present invention, multiple-heads on the bit may be other tools such as drills. In such other embodiments, the end of the shaft which is otherwise fabricated for insertion into the handle may advantageously be fabricated to be held by a chuck of a tool such as, for example, a power drill.

BRIEF DESCRIPTION OF THE DRAWING

The principles of the present invention may be understood by considering the detailed description together with the drawing, in which:

FIG. 4 shows, in pictorial form, a perspective view of a second embodiment of the inventive multiple-head screwdriver:

FIG. 5 shows, in pictorial form, an embodiment of a multiple-head for use in the inventive multiple-head tool;

To facilitate understanding, identical reference numerals have been used to denote identical elements common to the figures.

DETAILED DESCRIPTION

Figure 1:
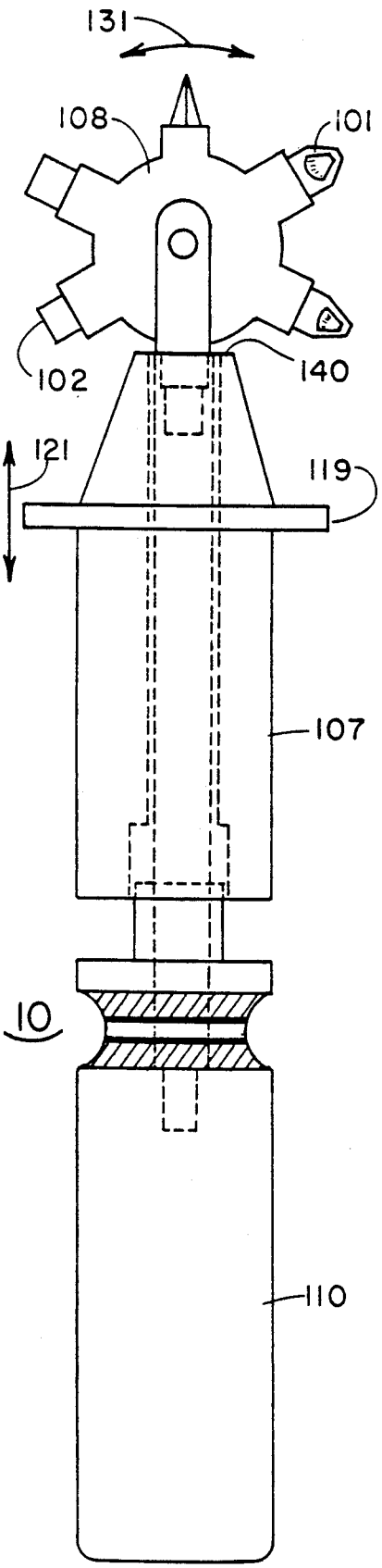
FIG. 1 shows, in pictorial form, a front view of an embodiment of the inventive multiple-head tool.
Figure 2:
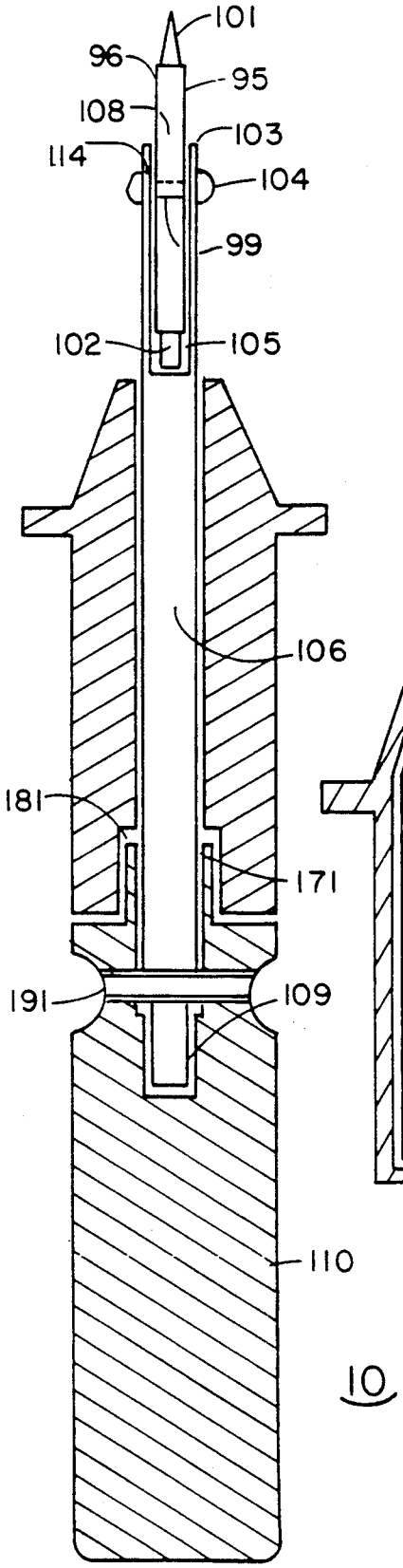
FIG. 2 shows, in pictorial form, a cross-section of the embodiment of the inventive multiple-head tool shown in FIG. 1 which cross-section is taken perpendicular to the side view shown in FIG. 1.

FIG. 1 shows a side view of multiple-head tool 10, a first embodiment of the present invention, and FIG. 2 shows a cross-section of multiple-head tool 10, which cross-section is taken perpendicular to the side view shown in FIG. 1. Handle 110 is preferably fabricated from an electrically insulated material such as wood or an electrically insulated plastic which is well known to those of ordinary skill in the art. Further, handle 110 may be covered by a material such as rubber to provide a better grip and/or the surface thereof may be knurled to provide a better grip.

As best shown in FIG. 2, end 109 of shaft 106 is inserted into handle 110. End 109 may be fixed in place or it may be removably inserted into handle 110. FIG. 2 shows that end 103 of shaft 106 has slot 105 axially disposed therein. Slot 105 extends from end 105 of shaft 106 along the axial extent thereof and is substantially centrally disposed within shaft 106. Aperture 114 is disposed near end 103 of shaft 106 and it passes through slot 105 substantially transverse to its axial extent. Screw or pin 104 is disposed in aperture 114 &o act, as will be described below, as an axle or pivot means.

Phillips-head bit 101 is affixed to multiple-head fixture 108 and flat-head bit 102 is affixed to multiple-head fixture 108 so that it is oppositely directed from bit 101. As shown in FIG. 2, multiple-head fixture 108 has an aperture 99 which passes through and substantially in the center of the fixture. Although the surfaces 95 and 96 of multiple-head fixture 108 are shown in the drawings to be substantially flat, the surfaces may have any shape as long as multiple-head fixture 108 and the tools and other apurtenances that are affixed thereto are able to fit within slot 105 of shaft 106 in accordance with the operation of the invention described below.

As shown in FIG. 2, multiple-head fixture 108 is disposed so that screw or pin 104 is inserted through aperture 114 in shaft 106 and aperture 99 in multiple-head fixture 108 and, as a result, screw or pin 104 acts as an axle or pivot means for rotating multiple-head fixture 108 thereabout. Screw or pin 104 is affixed in place by means well known to those of ordinary skill in the art such as by welds, bolts and so forth. In embodiments of the present invention: (1) screw or pin 104 is rotatable within aperture 114 in shaft 106 and multiple-head fixture 108 is rotatable about screw or pin 104; (2) screw or pin 104 is rotatable within aperture 114 and multiple-head fixture 108 is not rotatable about screw or pin 104; or (3) screw or pin 104 is not rotatable within aperture 114 but multiple-head fixture 108 is rotatable about screw or pin 104. In any case, screw or pin 104 acts as an axle means or a pivot for rotation of multiple-head fixture 108. In particular, multiple-head fixture 108 may be rotated so that phillips-head bit 101 extends substantially parallel to and outward from end 103 of shaft 106 and flat-head bit 102 is disposed substantially parallel to and within slot 105 of shaft 106 and vice versa.

Sleeve 107, preferably formed from electrically insulated material such as, for example, teflon, is disposed over shaft 106. Sleeve 107 can be translated along shaft 106 along the direction of arrow 121 towards end 103 of shaft 106 or back towards handle 110. Further, in a preferred embodiment, the outer surface of shaft 106 has a substantially circular cross-section and the inner surface sleeve 107 also has a substantiality circular cross-section. As a result, sleeve 107 may be rotated by 360° about shaft 106 in a clockwise or counterclockwise direction. Still further, sleeve 107 has lip 119 disposed on the outer surface thereof and disposed at a predetermined distance from end 140. In operation, lip 119 serves as a guard to prevent a user's hand from touching any of the heads. In addition lip 119 serves as a convenient means for translating sleeve 107 along shaft 106 in accordance with the manner described in detail below.

In configuring screwdriver 10 for use, sleeve 107 is translated down shaft 106 towards handle 110 to expose slot 105 as shown in FIG. 2. Then, multiple-head fixture 108 is rotated along the direction shown by arrow 131 of FIG. 1 so that the desired bit, for example, bit 101, extends outwardly from and substantially parallel to shaft 106. It should be understood that the present invention also includes embodiments wherein multiple-head fixture 108 can be rotated both clockwise and counterclockwise about screw or pin 104. As a result, another bit, for example, bit 102, will be disposed substantially parallel to and within slot 105. Finally, sleeve 107 is translated back along shaft 106 towards end 103 so that at least a portion of multiple-head fixture 108 is enclosed by sleeve 107 within slot 105, as shown in FIG. 1. As a result, sleeve 107 prevents multiple-head fixture 108 from rotating and thereby maintains it in a fixed position and ready for use.

Stability of operation of tool 10 is enhanced if mulitple-head fixture 108 fits snugly within slot 105. In addition, in a preferred embodiment, the cross-section of the outer surface of shaft 106 may be increased as end 103 is approached. As a result, sleeve 107 will fit more snugly on shaft 106 as it is translated to a position closer to end 103. Further, sleeve 107 may have additional lips disposed on the surface thereof and the surface of sleeve 107 may be knurled or the outer surface may have an irregular shape to provide a means for urging sleeve 107 towards end 103 or for pulling sleeve 107 back towards handle 110. Further, shaft 106 may also have a proturberance disposed on the outer surface thereof or another type of means for limiting the translation of sleeve 107 along the direction shown by arrow 121.

In use, one configures the desired bit in the manner described above and then holds screwdriver 10 by handle 110 in one hand and, optionally, by sleeve 107 in the other. Then while one hand applies torque to handle 110 to rotate the head to drive in or extract a screw, the other hand holds sleeve 107 as shaft 106 rotates therewithin. Sleeve 107 advantageously allows one to stabilize the screwdriver during these operations and, as a result, enables one advantageously to apply added pressure. In addition, in embodiments where handle 110 and sleeve 107 are fabricated from electrically insulated materials, one can work in the vicinity of electrical wires without fear of shock.

In further embodiments of the present invention, end 109 of shaft 106 may be fabricated in accordance with methods well known to those of ordinary skill in the art to fit into the chuck of a power tool such as an electric drill.

Figure 3:
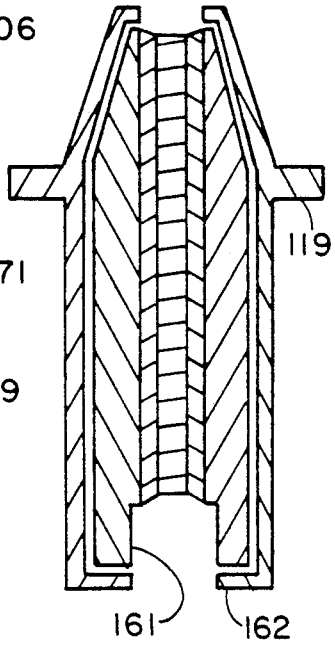
FIG. 3 shows, in pictorial form, a cross-section of a sleeve for use in an embodiment wherein the outer surface of the shaft of the multiple-head tool has a non-circular cross-section.

As shown in FIGS. 1 and 2, in an embodiment where the outer surface of shaft 106 has a substantially circular cross-section, sleeve 107 is advantageously comprised of a single piece of electrically insulating material whereas, in an embodiment wherein the outer surface of shaft 106 has, for example, a hexagonal cross-section, as shown in FIG. 3, sleeve 107 may be comprised of inner tube 161 having an inner, hexagonal cross-section and an outer, circular cross-section and outer tube 162 comprised of electrically insulating material, which outer tube 162 has inner and outer circular cross-sections and wherein lip 119 is disposed on the outer surface of outer tube 162.

As shown in FIG. 2, handle 110 has an extension 171 which extends along shaft 106 when shaft 106 is inserted into handle 110. Further, sleeve 107 contains a widened section 181 of its inner extent which is of sufficient size to fit over extension 171 Further, as shown in FIG. 1, widened section 181 extends a sufficent distance along the axial extent of sleeve 107 that shaft 106 is not exposed when sleeve 107 is disposed in position for use of tool 10. As one can readily appreciate, this configuration protects the user from electrical shock because if his or her hand is properly disposed behind lip 119, he or she cannot touch shaft 106 when he or she uses tool 10.

In still further embodiments of the present invention, end 109 of shaft 106 may be fabricated in accordance with a number of methods well known to those of ordinary skill in the art to be removably insertable into handle 110. In particular, as shown in FIG. 2, end 109 of shaft 106 is affixed to handle 110 by pin means 191. In addition, if screw or pin 104 is removable such as, for example, if it were a screw, then a number of different types of multiple-head fixtures containing bits may be inserted for use with the embodiment shown in FIG. 1.

FIG. 4 shows multiple-head screwdriver 20 having two heads, a second embodiment of the present invention wherein sleeve 107 has slot 132 formed at end 111 thereof. As shown in FIG. 4, in this embodiment, in addition to the configurations described above, screwdriver 20 may be configured so that rod 108 may be disposed substantially transverse to the axial extent of shaft 106. This is accomplished by translating sleeve 107 down shaft 107 towards end 103 far enough that slot 132 engages rod 108. In this configuration, bits 101 and/or 102 may be used to screw in or extract screws in locations which do not have sufficient clearance to allow for use of the full extent of screwdriver 20. This embodiment may be made more stable by ensuring that the inner surfaces of slot 105 snuggly fit the outer surfaces of rod 108. For example, this may be accomplished when both sets of surfaces are substantially planar.

It should be clear to those of ordinary skill in the art that many means can be fabricated to provide further support for rod 108 when a portion thereof is disposed within slot 105. For example, rod 108 may have protuberances disposed axially along opposed surfaces and slot 105 may have indents disposed axially along the axial extent thereof. Then when rod 108 is rotated so that a portion thereof lies substantially parallel to and within slot 105, the protuberances are disposed within the indents to provide support above and beyond that provided by sleeve 107. Many other means for support can be fabricated in accordance with methods well known to those of ordinary skill in the art and are all included within the spirit of the present invention.

Further, embodiments of the present invention also include multiple-head bits like multiple-head bit 30 shown in FIG. 5. Multiple-head b±t 30 includes the following tools: flat-heads 323, 324, and 325; phillips-heads 321, 322, 327, and 328; and awl 326. Flat-heads 323, 324, and 325 are different sizes of flat-heads and phillips-heads 321, 322, 327, and 328 are different sizes of phillips-heads. Note that the heads shown in FIG. 5 are disposed in pairs oriented at 180° with respect to each other. In this configuration, when one head of a pair is disposed substantially parallel to and within slot 105 of shaft 106, the other head of the pair extends outwardly from and substantially parallel to shaft 106 for use. Further, as described above, when sleeve 107 is moved down shaft 106 so that a portion thereof encloses slot 105, multiple-head bit 300 is prevented thereby from rotating. Still further, as should be clear to those of ordinary skill in the art, the angular position of the various heads enables one to use one head without interference from the others.

It should be clear to those of ordinary skill in the art that instead of utilizing pairs of heads as shown in FIG. 5, a multiple-head bit in accordance with the present invention may be fabricated were at least one of the pairs comprises a head and a shaft or a spur. In such an embodiment, the multiple-head bit will be prevented from rotating when the shaft or spur is disposed within slot 105. Clearly, the number of heads is not restricted to two or four and one may fabricate an embodiment where one uses four heads which are disposed substantially at right angles to each other instead of the eight heads shown in FIG. 5.

Although particular embodiments of the present invention have been shown and described herein, many varied embodiments incorporating the teachings of the present invention may be easily constructed by those skilled in the art. For example, a multiple-head bit may comprise different screwdriver heads or different sizes of one type of screwdriver head or different tools such as, for example, an awl, as well as screwdriver heads. Further, other embodiments of the present invention include the use of drill bits instead of screwdriver heads.

Figure 7:
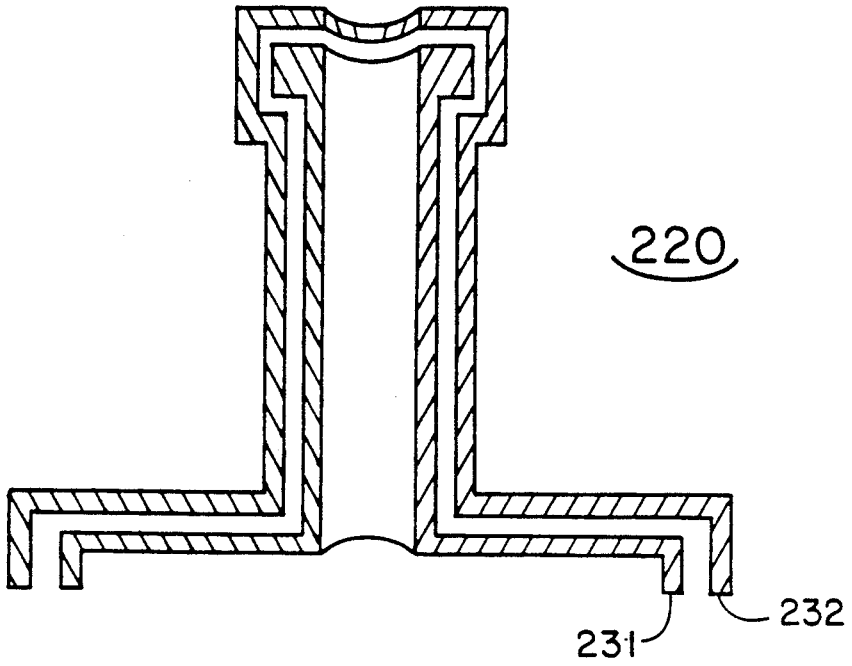
FIG. 7 shows, in pictorial form, an embodiment of a sleeve for use with the multiple-headed drill bit shown in FIG. 6.
Figure 6:
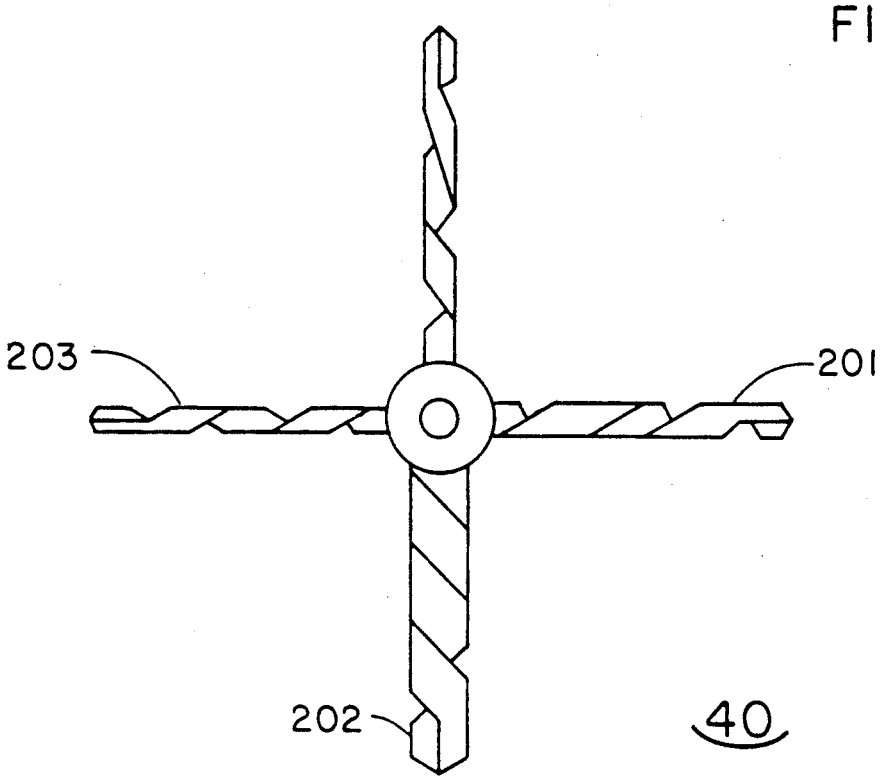
FIG. 6 shows, in pictorial form, an embodiment of a multiple-head formed from a multiplicity of drill bits for use in the inventive multiple-head tool.
Figure 8:
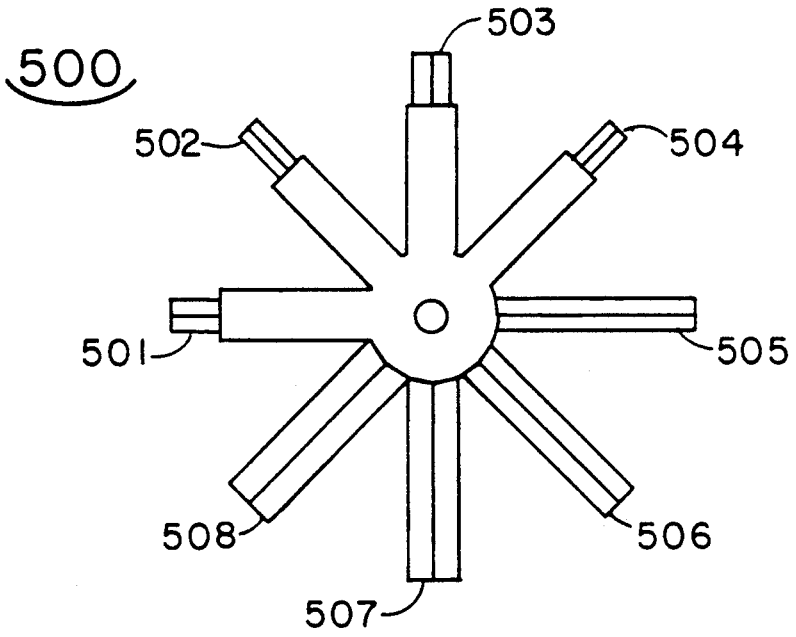
FIG. 8 shows, in pictorial form, an embodiment of a multiple-head formed from a combination of hesc-heads and robertson heads, for use in the inventive multiple-head tool.

For example, FIG. 6 shows multiple-head drill bit 40 comprising drill bits 200–203 for use in embodiments of the present invention. However, in embodiments which utilize multiple-head drill bit 40, it is preferred to use a sleeve which offers protection from one's touching one of the drill bits when the multiple-h-ad drill bit 40 is affixed to a shaft which is, in turn, inserted into the chuck of an electric drill. FIG. 7 shows a cross section of sleeve 220 for use with multiple-head drill bit 40.

Sleeve 220 is comprised of a first, inner sleeve 231 and an outer, interlocking sleeve 22. Sleeve 231 is adapted to rotate about the shaft on which it is disposed and sleeve 232 is adapted to rotate about sleeve 232. For example, both sleeves may be fabricate from a material such as teflon. Further, the mouth of the opening at the large end of sleeve 231 is at least as large at the length across the largest of the pairs of drill bits on multiple-head drill bit 40. This provides that when sleeve 220 is translated down a shaft, the pair of drill bits which extend outward from the shaft are substantially covered by the mouth of sleeve 231. Thus, one may hold sleeve 232 with ones hand to guide the drill and have protection from the spinning drill bits and any debris that might fly up from the surface being drilled.

What is claimed is:

1. A multiple-head tool which comprises:

shaft means having a slot disposed therein which extends from one end thereof longitudinally along a portion of the shaft;

pivot means affixed to the shaft substantially traverse to the longitudinal extent of the slot;

multiple-head bit means having a pivot point, which multiple-head bit means is mounted at the pivot point on the pivot means so that the multiple-head bit means may be rotated within the slot, which multiple-head bit means comprises:

at least one tool which extends substantially radially from the pivot point and at least one further means which extends substantially radially from the pivot point in substantially the opposite direction from the at least one tool; and sleeve means mounted on the shaft means and disposed to be longitudinally translatable along the shaft means, wherein:

at least the outer surface of the sleeve means is rotatable about the shaft by 360° so that the outer surface may be held continuously while the shaft is rotated; and at least the outer surface of the sleeve means is comprised of an electrically insulating material.

2. The multiple-head tool of claim 1 wherein the sleeve means further comprises a lip means which is disposed on and which protrudes above portions of the outer surface of the sleeve means and which lip means is spaced a predetermined distance from the ends of the sleeve means.

3. The multiple-head tool of claim 1 wherein the tool further comprises a handle into which the other end of the shaft means is inserted.

4. The multiple-head tool of claim 3 wherein the outer diameter of the shaft is larger at the one end thereof than it is at the other end.

5. The multiple-head tool of claim 3 wherein the pivot means is a pin means.

6. The multiple-head tool of claim 5 wherein the at least one tool is a flat-head screwdriver.

7. The multiple-head tool of claim 5 wherein the at least one tool is a phillips-head screwdriver.

8. The multiple-head tool of claim 5 wherein the at least one tool is a hex-head screwdriver.

9. The multiple-head tool of claim 5 wherein the at least one tool is a robertson-head screwdriver.

10. The multiple-head tool of claim 5 wherein the at least one tool is an awl.

11. The multiple-head tool of claim 6 wherein the at least one further means is phillips-head screwdriver.

12. A multiple-head tool which comprises:

shaft means having a slot disposed therein which extends from one end thereof longitudinally along a portion of the shaft;

pivot means affixed to the shaft substantially traverse to the longitudinal extent of the slot;

multiple-head bit means having a pivot point, which multiple-head bit means is mounted at the pivot point on the pivot means so that the multiple-head bit means may be rotated within the slot, which multiple-head bit means comprises:

at least one drill bit which extends substantially radially from the pivot point and at least one further means which extends substantially radially from the pivot point in substantially the opposite direction from the at least one drill bit; and sleeve means mounted on the shaft means and disposed to be longitudinally translatable along the shaft means, wherein:

at least the outer surface of the sleeve means is rotatable about the shaft by 360° so that the outer surface may be held continuously while the shaft is rotated and at least the outer surface of the sleeve means is comprised of an electrically insulating material.

13. A multiple-head tool which comprises:

shaft means having a slot disposed therein which extends from one end thereof longitudinally along a portion of the shaft;

pivot means affixed to the shaft substantially traverse to the longitudinal extent of the slot;

multiple-head bit means having a pivot point, which multiple-head bit means is mounted at the pivot point on the pivot means so that the multiple-head bit means may be rotated within the slot, which multiple-head bit means comprises:

at least one tool which extends substantially radially from the pivot point and at least one further means which extends substantially radially from the pivot point in substantially the opposite direction from the at least one tool; and sleeve means mounted on the shaft means and disposed to be longitudinally translatable along the shaft means, wherein:

at least the outer surface of the sleeve means is rotatable about the shaft by 360° so that the outer surface may be held continuously while the shaft is rotated;

at least the outer surface of the sleeve means is comprised of an electrically insulating material; and the sleeve means further comprises a lip means which is disposed on and which protrudes above portions of the outer surface of the sleeve means and a groove across one end of the sleeve means which is disposed substantially transverse to the longitudinal extent of the sleeve means.

14. The multiple-head tool of claim 3 wherein the sleeve means substantially covers the full length of the shaft which extends out of the handle.

* * * * *